US009145240B2

(12) United States Patent
Brozell

(10) Patent No.: US 9,145,240 B2
(45) Date of Patent: Sep. 29, 2015

(54) CONTAINER FITMENT

(71) Applicant: Owens-Brockway Glass Container Inc., Perrysburg, OH (US)

(72) Inventor: Brian J Brozell, Maumee, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 86 days.

(21) Appl. No.: 13/870,614

(22) Filed: Apr. 25, 2013

(65) Prior Publication Data

US 2014/0319178 A1 Oct. 30, 2014

(51) Int. Cl.
*B65D 49/04* (2006.01)
*B65B 43/00* (2006.01)
*B65D 1/02* (2006.01)

(52) U.S. Cl.
CPC ..... *B65D 49/04* (2013.01); *B65B 43/00* (2013.01); *B65D 1/023* (2013.01); *B65D 2101/00* (2013.01)

(58) Field of Classification Search
CPC ..... B65D 49/04; B65D 49/02; B65D 49/00; B65D 49/12
USPC ..... 222/147; 215/14, 15, 16, 17, 18, 20, 21, 215/23, 26, 28, 251
See application file for complete search history.

(56) References Cited

U.S. PATENT DOCUMENTS 512,374 A * 1/1894 Harper ..... 215/19
527,494 A * 10/1894 Howes ..... 215/17
584,225 A * 6/1897 Inglis ..... 215/26
619,310 A * 2/1899 Jackson ..... 215/25
629,307 A * 7/1899 Skanks ..... 215/21
683,883 A * 10/1901 Myers ..... 215/21
684,622 A * 10/1901 Sullivan ..... 215/17
707,068 A * 8/1902 Allen ..... 215/28
723,679 A * 3/1903 Kempter ..... 215/21
744,556 A * 11/1903 Kearney ..... 215/21
759,496 A 5/1904 Baker et al.
794,830 A * 7/1905 Wright ..... 215/20
815,112 A * 3/1906 O'Dell et al. ..... 215/18
816,121 A * 3/1906 Perry et al. ..... 215/21
816,170 A * 3/1906 Maxwell ..... 215/28

(Continued)

FOREIGN PATENT DOCUMENTS

DE 67021 C 2/1893
FR 427779 A 8/1911

OTHER PUBLICATIONS

Wikipedia contributors, "Interference fit," Wikipedia, The Free Encyclopedia, http://en.wikipedia.org/wiki/Interference_fit (accessed Mar. 26, 2015).*

(Continued)

*Primary Examiner* — Kevin P Shaver
*Assistant Examiner* — Michael J Melaragno

(57) ABSTRACT

An anti-refill product including a container having a neck integral with a body and shoulder of the container. The neck has a neck finish terminating in a lip, a valve seat axially between the shoulder and the lip and including a single, a circumferentially continuous, internal valve sealing surface extending completely around the neck, and a valve retainer axially between the valve seat and the lip, and including a radially inwardly extending projection that includes at least one internal valve retaining surface. A check element is separate from the container and carried in the container neck between the valve seat and the valve retainer.

18 Claims, 2 Drawing Sheets

(56) References Cited

U.S. PATENT DOCUMENTS

| | | | | | |
|---|---|---|---|---|---|
| 816,744 | A | * | 4/1906 | Rodgers | 215/28 |
| 828,103 | A | * | 8/1906 | Fitzsimmons | 215/21 |
| 845,579 | A | * | 2/1907 | Rothweiler | 215/14 |
| 932,956 | A | * | 8/1909 | Burns | 215/21 |
| 989,964 | A | * | 4/1911 | Hand et al. | 215/21 |
| 1,025,577 | A | * | 5/1912 | Koehler et al. | 215/21 |
| 1,047,662 | A | * | 12/1912 | Langton et al. | 215/21 |
| 1,064,851 | A | * | 6/1913 | Nishida | 215/24 |
| 1,113,953 | A | * | 10/1914 | Browning | 222/147 |
| 1,133,225 | A | * | 3/1915 | Boser et al. | 215/27 |
| 1,183,304 | A | * | 5/1916 | Leitheiser | 215/25 |
| 1,192,374 | A | | 7/1916 | Benson | |
| 1,305,549 | A | * | 6/1919 | Kerr | 215/27 |
| 1,415,741 | A | * | 5/1922 | Walsh | 215/14 |
| 1,438,851 | A | * | 12/1922 | Parsons | 215/21 |
| 1,438,852 | A | * | 12/1922 | Parsons | 215/21 |
| 1,446,162 | A | * | 2/1923 | Dague | 215/18 |
| 1,721,662 | A | * | 7/1929 | Herzick | 215/17 |
| 2,024,843 | A | * | 12/1935 | Belgeri et al. | 215/30 |
| 2,031,821 | A | * | 2/1936 | Della Libera Y Silicani | 215/25 |
| 2,032,478 | A | | 3/1936 | Haase | |
| 2,047,270 | A | * | 7/1936 | Keenan | 215/21 |
| 2,081,823 | A | * | 5/1937 | Kunz | 215/17 |
| 2,091,460 | A | * | 8/1937 | Valliant et al. | 215/18 |
| 2,122,595 | A | * | 7/1938 | Stonebraker | 215/21 |
| 3,399,811 | A | * | 9/1968 | Miller | 222/147 |
| 3,407,955 | A | * | 10/1968 | Masi | 215/22 |
| 3,632,003 | A | * | 1/1972 | De Simone | 215/21 |
| 3,794,202 | A | * | 2/1974 | Unger | 215/22 |
| 4,377,242 | A | * | 3/1983 | Snedker | 215/21 |
| 4,740,401 | A | * | 4/1988 | Barkhau et al. | 428/34.6 |
| 5,305,925 | A | * | 4/1994 | Vogel | 222/147 |
| 5,743,437 | A | * | 4/1998 | Moore et al. | 222/147 |
| 6,059,131 | A | * | 5/2000 | Harris | 215/18 |
| 6,230,937 | B1 | * | 5/2001 | Johnson et al. | 222/147 |
| 6,595,230 | B2 | * | 7/2003 | Raboin | 137/1 |
| 6,619,492 | B2 | * | 9/2003 | Battegazzore | 215/21 |
| 7,140,519 | B1 | * | 11/2006 | Kiser | 222/500 |
| 7,398,890 | B2 | * | 7/2008 | Thomson | 215/252 |
| 7,562,783 | B2 | | 7/2009 | Bourreau et al. | |
| 7,802,703 | B2 | | 9/2010 | Kiser | |
| 2007/0090127 | A1 | * | 4/2007 | Kiser | 222/95 |
| 2007/0262042 | A1 | * | 11/2007 | Pareja | 215/17 |
| 2008/0164289 | A1 | * | 7/2008 | Kiser | 222/500 |
| 2014/0076932 | A1 | * | 3/2014 | Kellogg et al. | 222/147 |
| 2014/0076933 | A1 | * | 3/2014 | Chisholm | 222/147 |
| 2014/0076934 | A1 | * | 3/2014 | Laib et al. | 222/147 |

OTHER PUBLICATIONS

PCT Search Report and Written Opinion, Int. Serial No. PCT/US2014/033449, Int. Filing Date: Apr. 9, 2014, Applicant: Owens-Brockway Glass Container Inc., Mail Date: Jun. 25, 2014.

* cited by examiner

CONTAINER FITMENT

The present disclosure is directed to containers and, more particularly, to non-refillable containers and fitments therefor.

BACKGROUND AND SUMMARY OF THE DISCLOSURE

A container for carrying a liquid product can include a fitment that renders the container non-refillable so as to impede or prevent efforts to refill the container with inferior products. U.S. Pat. No. 3,399,811 illustrates a container of this type.

A general object of the present disclosure, in accordance with one aspect of the disclosure, is to provide a product including a container and a non-refillable fitment that is non-removably secured to the container, and that indicates opening of the container and/or evidences efforts to tamper with the package via breakage of the container and/or the fitment.

The present disclosure embodies a number of aspects that can be implemented separately from or in combination with each other.

An anti-refill product in accordance with one aspect of the disclosure includes a container including a body, a shoulder integral with and extending from the body, and a neck integral with and extending from the shoulder. The neck includes a neck finish terminating in a lip, a valve seat axially between the shoulder and the lip, and including a single, circumferentially continuous, internal valve sealing surface extending completely around the neck, and a valve retainer axially between the valve seat and the lip, and including at least one radially inwardly extending projection that includes at least one internal valve retaining surface. The product also includes a check element separate from the container and carried in the container neck between the valve seat and the valve retainer.

In accordance with another aspect of the disclosure, there is provided a method of producing a product that includes forming a glass container including a body, a shoulder integral with and extending from the body, and a neck integral with and extending from the shoulder and including a valve retainer, and a valve seat integral with the neck and located axially between the shoulder and the valve retainer. The method also includes assembling a check element into the neck so that the check element seats against the valve seat.

In accordance with a further aspect of the disclosure, there is provided a package that includes a container having a neck, an anti-refill valve in the neck including a check element, and a closure removably secured to the neck to close the package. The package is characterized in that the anti-refill check element is coupled to the closure such that removal of the closure from the neck separates the valve ball from the closure so that the check element functions both as a valve element of the anti-refill valve and as means for indicating that the package has been opened.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
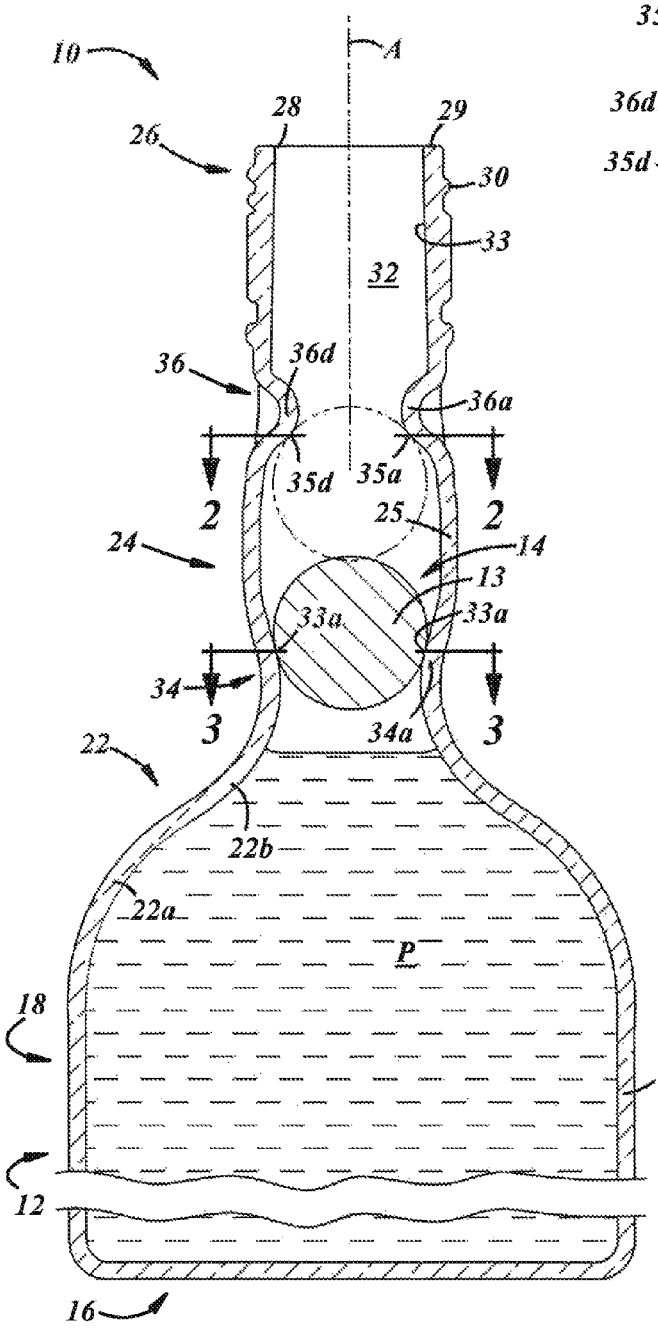
FIG. 1 is a fragmentary, elevational, cross-sectional view of a product in accordance with an illustrative embodiment of the present disclosure and including a container and a fitment coupled to the container to render the container non-refillable.

FIG. 1 illustrates a product 10 in accordance with an illustrative embodiment of the disclosure as including a container 12 to hold a liquid product P, and a dispensing fitment 14 coupled to the container 12. The fitment 14 may be non-removably secured to the container 12. The terminology "non-removably secured" includes a manner in which the fitment 14 is, by design-intent, not intended to be removed from the container 12 without damaging the container 12 and/or the fitment 14 or other component, or otherwise visibly compromising the structural and/or functional integrity of either or both. Also, the fitment 14 may render the container 12 non-refillable. In other words, the fitment 14 may prevent or at least impede efforts to refill the container 12, for example, with counterfeit liquid products. The terminology "non-refillable" is used interchangeably herein with the terms refill-resistant and anti-refill, and includes a characteristic of the fitment 14 which, by design intent, is not intended to be refilled without damaging the container 12 and/or fitment 14 or otherwise visibly compromising the structural and/or functional integrity of either or both.

The container 12 can be a bottle, for example, a wine or spirits bottle or any other suitable type of bottle or container, and can be composed of metal, plastic, glass, or ceramic material(s). As used herein, the term ceramic may include inorganic material containing silicon, silicon oxide, and/or silicate. For example, ceramics may include fired clay shaped before high-temperature treatment and then fired to form porcelain, pottery, or the like, and also glass which is shaped after high-temperature treatment.

The container 12 may include a bottom or base 16, a body 18 integral with the base 16, and a shoulder 22 integral with the body 18. The body 18 may include a sidewall 20 that may extend in a direction away from the base 16 generally along a central longitudinal axis A of the container 12. Likewise, the shoulder 22 extends in a direction away from the sidewall 20 of the body 18 and may include an excurvate wall **22*a* extending from the body sidewall 20, and an incurvate wall 22*b* extending from the excurvate wall 22*a***.

The container 12 also includes a neck 24 integral with the shoulder 22, and extending in a direction away from the shoulder 22. The neck 24 includes a neck finish 26 with an open end or mouth 28, and terminates in an axial end surface or lip 29 around the mouth 28. The neck finish 26 also may include one or more closure engagement features 30, which may include one or more threads, thread segments, or any other suitable closure engagement feature(s). The container neck 24 also may include an interior passage 32 to receive the fitment 14 and a corresponding interior surface 33 to communicate liquid out of the container body 18 and through and out of the neck 24. As used herein, directional words such as top, bottom, upper, lower, radial, circumferential, lateral, longitudinal, transverse, vertical, horizontal, and the like are employed by way of description and not limitation.

Figure 3:
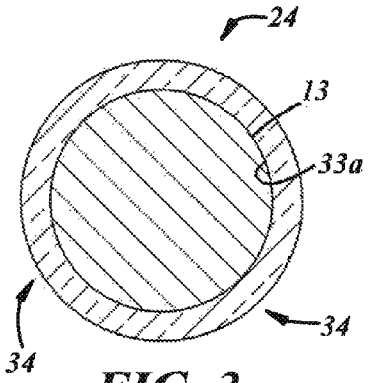
FIG. 3 is a cross-sectional view of the product of FIG. 1, taken along line 3-3 of FIG. 1.

Still referring to FIG. 1, the container neck 24 also includes a valve seat 34, which is positioned axially between the shoulder 22 and the neck finish 26, and includes a single, internal, circumferentially continuous, valve sealing surface 33*a* (FIGS. 1 and 3) extending completely around the neck 24. The valve seat 34 may include a wall 34*a* that may be incurvate as shown in the illustrated embodiment, or may be of internal frustoconical shape, or of any other suitable shape. The container neck 24 also may include a wall 25 extending from the wall 34*a*, wherein the wall 25 may be excurvate or straight with an internal dimension larger than the fitment 14 to establish a fitment chamber in which the fitment 14 may move axially.

Figure 2:
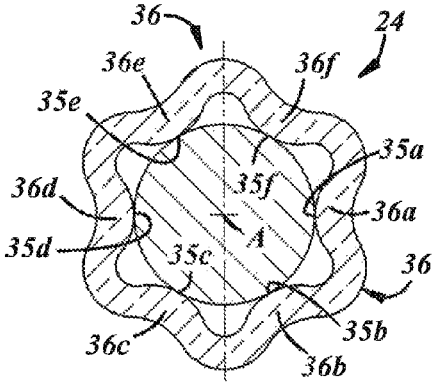
FIG. 2 is a cross-sectional view of the product of FIG. 1, taken along line 2-2 of FIG. 1.

The container neck 24 further includes a valve retainer 36 axially between the valve seat 34 and the lip 29. In the illustrated embodiment, the retainer 36 includes a radially inwardly indented wall having one or more circumferentially spaced, radially inwardly extending projections. For example, the projections may include pegs, nubs, ribs, or any other suitable projections, for instance, incurvate lobes 36*a-f* (FIG. 2) that include one or more corresponding, circumferentially spaced, internal valve retaining surfaces 35*a-f* (FIG. 2) that may extend completely around the neck 24. The lobes 36*a-f* may be circumferentially interspersed by excurvate lobes. Accordingly, in the illustrated embodiment, the neck 24 may have a radially indented, circumferentially undulating external surface at the retainer 36. In other embodiments, the retainer 36 may include only one radially inwardly extending projection sufficient to trap the fitment 14 and establish at least one outflow passage between the fitment 14 and the neck 24.

In the aforementioned preferred embodiments, the valve seat 34 and the retainer 36 may be integrally formed with the neck 24. In further embodiments, the valve retainer 36 may include a separate component non-removably secured within the container neck 24. For example, the valve retainer 36 may include a sleeve or ring tightly press fit within the container neck 24, shrink fit therein, and/or interengaged thereto in any suitable manner, for instance, by being axially trapped by internal embossments or projections (not shown) of the container neck 24.

The fitment 14 may include a check element 13 that may be axially movably carried in the container 12 between the valve seat 34 and the valve retainer 36 as part of a check valve established by the fitment 14 and the container 12. In one embodiment, as illustrated for example, the fitment 14 may include only one component: the check element 13. Likewise, the check valve may include only two components: the container 12 and the check element 13, with no other components required for satisfactory check valve functionality. In another embodiment, the fitment 14 also may include a carrier, valve seat, or valve housing for the check element 13, or the valve retainer 36 in an embodiment where the valve retainer 36 is separate from the container 12. The check element 13 may directly contact interior surfaces of the container neck 24, including surfaces of the valve seat 34 and/or the valve retainer 36. Also, the composition of the container 12 and the check element 13 may be the same, for example, both may be composed of glass.

As illustrated, the check element 13 may include a check ball, but also or instead may include a check plate, or any other suitable check element of any suitable shape and configuration. The check element 13 may be composed of glass or other ceramic material, metallic material, polymeric material, and/or any other suitable type(s) of material. In one embodiment, the check element may include a decorative feature, for example, marbling, coloring, patterning, or indicia, for instance, a brand logo or slogan, or any other suitable decoration. In another embodiment, the check element 13 may be composed of a substrate material and a coating material, for example, a non-ferrous substrate and an elastomeric coating on the substrate, more specifically, a silicone rubber over an aluminum ball. The illustrated check element 13 is separate from the container 12, is carried in the container neck 24, and is loosely trapped axially between the valve seat 34 and the valve retainer 36 as depicted in solid lines in one position and in phantom lines in another position.

In cooperation with the valve seat 34 of the container 12, the check element 13 impedes or prevents refilling of the container 12, and, in cooperation with the valve retainer 36, permits flow of liquid product P out of the container 12 through the neck 24. When the product 10 is in an inverted position, the check element 13 seats against the retaining surfaces 35*a-f*, for example, in direct contact therewith, such that one or more flow paths is/are defined between the check element 13 and the valve retainer 36, as shown among FIGS. 1 and 2. But, as shown among FIGS. 1 and 3, when the product 10 is in an upright position, the check element 13 seals against the check element sealing surface 33*a* so as to prevent refilling of the container 12.

Referring to FIG. 1, the check element 13 may provide a brittle and impenetrable security component. Therefore, if, as they are known to do, counterfeiters attempt to breach the fitment 14 by force, the container 12 and/or the check element 13 will fracture or shatter, thereby facilitating evidence of tampering with the container 12 and likely rendering the container 12 unusable. In another embodiment, the check element 13 may be composed of a relatively ductile material so that it cannot be shattered and removed from the container 12. For example, the check element 13 may be composed of a metal, for instance, stainless steel, aluminum, or any other suitable metal. The check element 13 is greater in size than corresponding inner radial dimensions of the valve retainer 36 and of the valve seat 34 when the check element 13 and the valve retainer 36 and the valve seat 34 are at the same temperature.

In general, the product 10 described above can be produced in any suitable manner. The container 12 is preferably composed of glass, but may be composed of any other suitable material including plastic or metal, and may be of one-piece integrally formed construction. (The term "integrally formed construction" does not exclude one-piece integrally molded layered constructions of the type disclosed in, for example, U.S. Pat. No. 4,740,401, or one-piece containers to which other structure is added after the container-forming operation.) In a glass embodiment, the containers may be fabricated in a press-and-blow, narrow neck press-and-blow, or a blow-and-blow container manufacturing operation.

For example, a typical glass container manufacturing process includes a "hot end" and a "cold end." The hot end may include one or more glass melting furnaces to produce a glass melt, one or more forming machines to form the glass melt into containers, and one or more applicators to apply a hot-end coating to the containers. The "hot end" also may include an annealing lehr, or at least a beginning portion of the annealing lehr, for annealing the containers therein. Through the lehr, the temperature may be brought down gradually to a downstream portion, cool end, or exit of the lehr. The "cold end" may include an end portion of the annealing lehr, applicators to apply one or more cold-end coatings to the containers downstream of the annealing lehr, inspection equipment to inspect the containers, and packaging machines to package the containers.

In conjunction with the above description, the containers may be produced by the following container manufacturing process, which may or may not include all of the disclosed steps or be sequentially processed or processed in the particular sequence discussed, and the presently disclosed manufacturing process encompasses any sequencing, overlap, or parallel processing of such steps.

First, a batch of glass-forming materials may be melted. For example, a melting furnace may include a tank with melters to melt soda-lime-silica to produce molten glass. Thereafter, the molten glass may flow from the tank, through a throat, and to a refiner at the downstream end of the furnace where the molten glass may be conditioned. From the furnace, the molten glass may be directed toward a downstream forehearth that may include a cooling zone, a conditioning zone, and a downstream end in communication with a gob feeder. The feeder may measure out gobs of glass and deliver them to a container forming operation.

Next, the glass gobs may be formed into containers, for example, by forming machines, which may include press-and-blow or blow-and-blow individual section machines, or any other suitable forming equipment. Blank molds may receive the glass gobs from the feeder and form parisons or blanks, which may be at a temperature on the order of 900-1100 degrees Celsius. Blow molds may receive the blanks from the blank molds and form the blanks into containers, which may be at a temperature on the order of 700-900 degrees Celsius. Material handling equipment may remove the containers from the forming machines and place the containers on conveyors or the like. The containers may be formed to include the valve seat 34 and the valve retainer 36.

Also, the formed containers may be annealed, for example, by an annealing lehr. At an entry, hot end, or upstream portion of the annealing lehr, the temperature therein may be, for instance, on the order of 500-700 degrees Celsius. Through the lehr, the temperature may be brought dawn gradually to a downstream portion, cool end, or exit of the lehr, for example, to a temperature therein on the order of 100 degrees Celsius.

The check element 13 may be assembled to the container 12 at any suitable point(s) in a container manufacturing process, for instance, in the one set forth above or any other, or in a downstream process, for example, during a bottling operation at a bottling plant. Those of ordinary skill in the art will recognize that the drawing figures are not precisely to scale and, thus, the differences in sizes between the check element 13 and the valve seat 34 and the valve retainer 36 may not be as significant as that shown. In one example, under nominal material conditions of the container 12 and the element 13, the outside dimension of the widest portion of the element 13 may be on the order of 0.002" larger than the inside dimension of the narrowest portion of the retainer 36. The check element 13 may be assembled past the sealing lip 29 and into the neck 24 of the container 12 under a manufacturing differential between the check element 13 and the valve retainer 36 that allows passage of the check element 13 through the valve retainer 36 but not through the valve seat 34.

For example, in one embodiment, the manufacturing differential may include a thermal differential. In this embodiment, an outer dimension of the check element 13 will be smaller than a corresponding inner dimension of the valve retainer 36 of the container 12 to allow the check element 13 to be assembled into the container neck 24 past the retainer 36 so as to come to rest on the valve seat 34, which is smaller in diameter than the check element 13. In one example of this embodiment, the check element 13 may be cooled below a suitable cold temperature. For example, the check element 13 may be exposed to liquid nitrogen, for instance, by being submerged therein, sprayed therewith, or the like, and then dropped into the container 12, which may be at room temperature or an elevated temperature. In another example of this embodiment, the check element 13 may be at room temperature (e.g. 15-40 degrees Celsius) and dropped into a hot container 12. For example, the check element 13 may be assembled into the container neck 24 after forming of the container 12 but before, during, or after annealing of the container 12.

In another embodiment, the manufacturing differential may include a geometric differential. In this embodiment, an outer dimension of the check element 13 may be larger than a corresponding inner dimension of the valve retainer 36 of the container 12. For example, the check element 13 and the container 12 may be at any suitable temperatures, and the check element 13 may be forced into position between the retainer 36 and the seat 34. For example, the check element 13 may be press fit into the container 12.

In either of the aforementioned embodiments, a fluid may be used to facilitate assembly of the check element 13 to the container 12. For example, the fluid may include a wax, oil, water, or any other suitable liquid for lubrication, insulation, or any other suitable purpose.

In an additional embodiment, the container 12 may be formed to include the valve seat 34, and then the check element 13 may be assembled into the container neck 24, and, thereafter, the container 12 may be partially reformed to include the valve retainer 36 and/or the valve retainer 36 may be non-removably secured to the container 12 when the retainer 36 is a separate component. In a similar embodiment, the container 12 may be formed to include the valve seat 34, and the valve retainer 36 in a partially formed state, and then the check element 13 may be assembled into the container neck 24, and, thereafter, the container 12 may be partially reformed to complete the valve retainer 36 so as to trap the check element 13 in the container neck 24.

Figure 4:
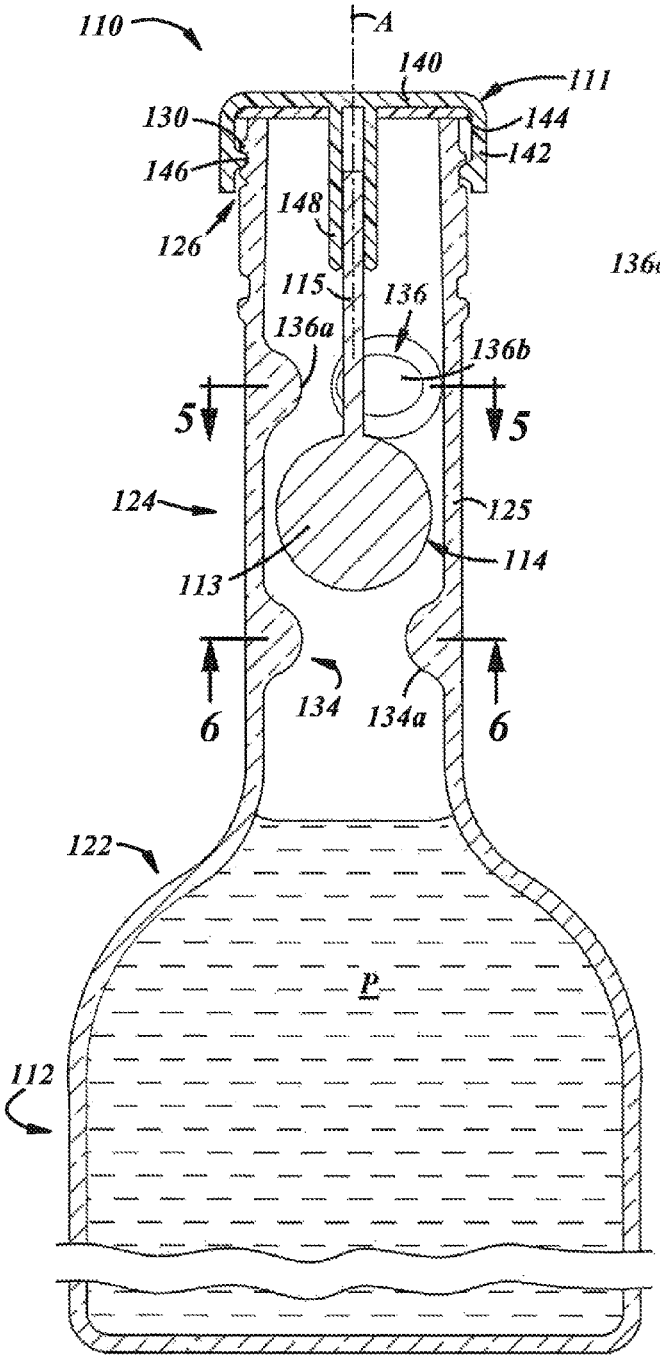
FIG. 4 is a fragmentary, elevational, cross-sectional view of a product in accordance with another illustrative embodiment of the present disclosure and including a container and a fitment coupled to the container to render the container non-refillable.
Figure 5:
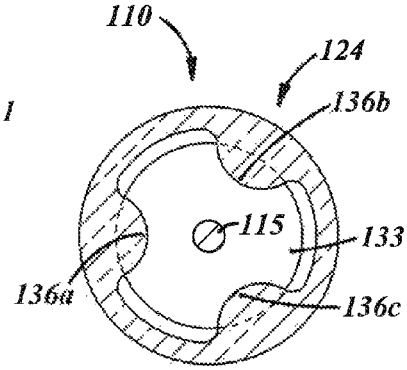
FIG. 5 is a cross-sectional view of the product of FIG. 4, taken along line 5-5 of FIG. 4.
Figure 6:
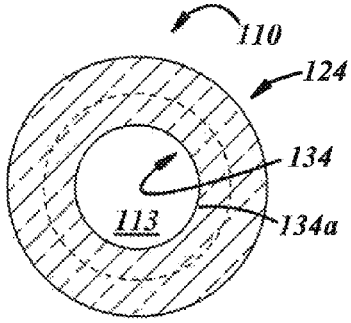
FIG. 6 is a cross-sectional view of the product of FIG. 4, taken along line 6-6 of FIG. 4.

FIGS. 4-6 illustrate another illustrative embodiment of a product 110. This embodiment is similar in many respects to the embodiment of FIGS. 1-3 and like numerals between the embodiments generally designate like or corresponding elements throughout the several views of the drawing figures. Accordingly, the descriptions of the embodiments are incorporated into one another. Additionally, the description of the common subject matter generally may not be repeated here.

With reference to FIG. 4, the product 110 includes a container 112, a closure 111 removably securable to the container 112, a fitment 114 that includes a check element 113 and a coupling 115 between the closure 111 and the check element 113. The product 110 is illustrated as a package in its original factory sealed state or condition, with an authentic, genuine, or original material or product P filling the container 112. The fitment 114 may facilitate evidencing of efforts to open the product 110, for example, via release of the check element 113 when someone attempts to remove the closure 111 from the container 112.

The container 112 includes a neck 124 with a neck finish 126, a valve seat 134, and a valve retainer 136. In this embodiment, the valve seat 134 includes an internal embossment **134*a* that establishes a valve sealing surface, and the valve retainer 136 includes at least one internal embossment. In the illustrated embodiment, the retainer 136 includes three equidistantly circumferentially spaced, radially inwardly extending projections, for instance, embossments 136*a*, 136*b*, 136*c* (FIG. 5**) that establish one or more valve retaining surfaces.

The embossments may be similar to the embossments of, and produced by the method(s) disclosed in, U.S. Pat. No. 8,333,287 and/or U.S. Pat. App. Pub. No. 2009/0084799, which are assigned to the assignee hereof and are incorporated by reference herein in their entireties.

The container neck 124 also may include a wall 125 extending between the valve seat 134 and the valve retainer 136, wherein the wall 125 may be straight with an internal dimension larger than the fitment check element 113 to establish a fitment chamber in which the fitment 114 may move axially. The wall 125 may be straight between the retainer 136 and the seat 134, and between the seat 134 and a shoulder 122 of the container 112.

The closure 111 may include a base wall 140, an outer annular skirt 142 extending from the base wall 140, and a liner 144 carried by the base wall 140 within the skirt 142. The skirt 142 may include one or more container engagement features 146, which may include one or more threads, thread segments, or any other suitable feature(s) for engagement with one or more corresponding closure engagement features 130 of the container 112.

The coupling 115 couples the check element 113 to a portion of the closure 111 radially inward of the outer annular skirt 142 and in any suitable manner. For example, the coupling 115 may be coupled to the closure 111 by assembly, ultrasonic welding, adhesive, or in any suitable manner. In the illustrated embodiment, the coupling 115 may be a relatively rigid, elongated member, for instance, a stem, extending from the element 113 toward the base wall 140 of the closure 111 and terminating in a free end coupled to a socket 148 in or extending from the base wall 140. Likewise, the coupling 115 may be coupled to the check element 113 by integral forming, assembly, ultrasonic welding, adhesive, or in any suitable manner. In other embodiments, the coupling 115 may include a relatively flaccid elongated member, for example, a string, wire, or the like.

Accordingly, the check element 113 is releasably coupled to the closure 111, and is releasable from the closure 111 into the container 112, for example, against the valve seat 134, upon removal of the closure 111 from the container 112. As such, the check element 113 is a pendant or drop-style package opening indicator that drops into the container 112 upon closure removal. As such, the check element 113 may facilitate evidencing of efforts to tamper with the package 110, by providing visible evidence that the package 110 has been opened from its original factory sealed condition. As used herein, the term "removal" may include partial or complete removal.

As suggested in FIG. 5, when the product 110 is in an inverted position with the closure 111 removed, the check element 113 seats against corresponding surfaces of the retainer embossments 136*a-c*, for example, in direct contact therewith, such that one or more flow paths is/are defined between the check element 113 and the valve retainer 136 of the neck 124.

But, as suggested in FIG. 6, when the product 110 is in an upright position with the closure 111 removed, the check element 113 seals against a sealing surface of the seal embossment 134*a* of the valve seat 134 of the neck 124 so as to prevent refilling of the container 112.

There thus has been disclosed a product that is non-refillable and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. An anti-refill package that includes:

a container including:

a body, a shoulder integral with and extending from the body, and a neck integral with and extending from the shoulder and including:

a neck finish terminating in a lip, a valve seat axially between the shoulder and the lip, and including a single, circumferentially continuous, internal valve sealing surface extending completely around the neck, and a valve retainer axially between the valve seat and the lip, and including at least one radially inwardly extending projection that includes at least one internal valve retaining surface, a check element separate from the container and carried in the container neck between the valve seat and the valve retainer, wherein when the product is in an inverted position the check element seats against the retaining surfaces such that at least one flow path is defined between the check element and the valve retainer, and when the product is in an upright position the check element seals against the check element sealing surface so as to prevent refilling of the container; and a closure including a base wall and an outer annular skirt extending axially from the base wall, and being removably secured to the neck finish and removably secured to the check element via a releasable direct coupling between the check element and the closure base wall in a location radially within the outer annular skirt, wherein removal of the closure from the neck separates the check element from the closure so that the check element functions both as a valve element of the anti-refill valve and as an indication that the package has been opened, wherein the check element is a pendant that drops into the container upon closure removal.

2. The package set forth in claim 1, wherein the check element is greater in size than inner radial dimensions of the valve retainer and of the valve seat when the check element and the valve retainer and valve seat are at the same temperature.

3. The package set forth in claim 1, wherein the container is composed of at least one of a ceramic material or a metallic material, and the check element is composed of at least one of a ceramic material, a non-ferrous metallic material, or a polymeric material.

4. The package set forth in claim 1, wherein the at least one radially inwardly extending projection of the valve retainer is part of an indented wall having a plurality of circumferentially spaced lobes that include multiple, circumferentially spaced internal valve retaining surfaces.

5. The package set forth in claim 1, wherein the at least one radially inwardly extending projection of the valve retainer includes at least one internal embossment.

6. The package set forth in claim 1, wherein the at least one radially inwardly extending projection includes at least two projections.

7. The package set forth in claim 1, wherein the at least one radially inwardly extending projection include at least three circumferentially spaced projections.

8. The package set forth in claim 1, wherein the at least one radially inwardly extending projection includes a plurality of circumferentially spaced lobes circumferentially interspersed by excurvate lobes, such that the neck has a radially indented, circumferentially undulating external surface at the valve retainer.

9. A method of using the package set forth in claim 1 including removing the closure from the container to uncouple the closure from the check element to indicate that the package has been opened.

10. A method of producing a product that includes:

forming a glass container including a body, a shoulder integral with and extending from the body, and a neck integral with and extending from the shoulder and including a valve retainer integral with the neck, and a valve seat integral with the neck and located axially between the shoulder and the valve retainer;

assembling a check element into the neck so that the check element seats against the valve seat and according to a thermal differential between the check element and the valve retainer that allows passage of the check element through the valve retainer but not through the valve seat, releasably securing the check element to a closure having a base wall and an outer annular skirt, via a releasable direct coupling between the check element and the closure base wall in a location radially within the outer annular skirt; and removably securing the closure to the neck, wherein the check element is a pendant that drops into the container upon closure removal.

11. The method set forth in claim 10 wherein the thermal differential includes a relatively cool check valve element and a relatively warm container.

12. A package including the product produced by the method of claim 10.

13. A method of using the package set forth in claim 12 including removing the closure from the container to uncouple the closure from the check element to indicate that the package has been opened.

14. A package that includes:

a container having a neck, an anti-refill valve in the neck including a check ball, and a closure removably secured to the neck to close the package, wherein the closure includes a base wall and an outer annular skirt extending axially from the base wall, characterized in that the anti-refill check ball is releasably directly coupled to the closure base wall in a location radially within the outer annular skirt, wherein removal of the closure from the neck separates the valve ball from the closure so that the check ball functions both as a valve element of the anti-refill valve and an indication that the package has been opened, and wherein the check element is a pendant that drops into the container upon closure removal.

15. The package set forth in claim 14, wherein the closure has a radially inner portion, and the check ball is releasably coupled to the radially inner portion of the closure.

16. The package set forth in claim 1, wherein the check element includes a stem releasably directly coupled to a socket extending from the closure base wall.

17. The method set forth in claim 10, wherein the releasably securing step includes releasably directly coupling a stem of the check element to a socket extending from the closure base wall.

18. The package set forth in claim 14, wherein the check ball includes a stem releasably directly coupled to a socket extending from the closure base wall.

* * * * *